US007861322B2

(12) United States Patent
Cho

(10) Patent No.: US 7,861,322 B2
(45) Date of Patent: Jan. 4, 2011

(54) SIZE ADJUSTER AND HEADWEAR USING THE SAME

(75) Inventor: Byoung-Woo Cho, Gyeonggi-Do (KR)

(73) Assignee: Yupoong, Inc., Seoul (KR)

( * ) Notice: Subject to any disclaimer, the term of this patent is extended or adjusted under 35 U.S.C. 154(b) by 929 days.

(21) Appl. No.: 11/609,665

(22) Filed: Dec. 12, 2006

(65) Prior Publication Data

US 2008/0134414 A1 Jun. 12, 2008

(51) Int. Cl.
*A42B 1/22* (2006.01)

(52) U.S. Cl. ..... 2/183; 24/301; 24/265 BC; 24/265 EC; 24/265 WS; 24/265 R

(58) Field of Classification Search ..... 2/183, 2/338, 309, 311, 317; 24/301, 265 BC, 265 EC, 24/265 WS, 265 R
See application file for complete search history.

(56) References Cited

U.S. PATENT DOCUMENTS

| | | | |
|---|---|---|---|
| 5,715,540 | A | 2/1998 | Cho |
| 5,862,522 | A | 1/1999 | Cho |
| 6,067,658 | A | 5/2000 | Cho |
| 6,089,421 | A | 7/2000 | Cho |
| 6,115,844 | A | 9/2000 | Cho |
| 6,119,273 | A | 9/2000 | Cho |
| 6,129,250 | A | 10/2000 | Cho |
| 6,314,583 | B1 | 11/2001 | Cho |
| D505,775 | S | 6/2005 | Cho |
| 6,986,166 | B2 | 1/2006 | Cho |
| D514,281 | S | 2/2006 | Cho |
| 7,011,034 | B2 | 3/2006 | Cho |
| D520,716 | S | 5/2006 | Cho |
| D521,713 | S | 5/2006 | Cho |
| 2004/0019954 | A1 | 2/2004 | Park |
| 2004/0154140 | A1 | 8/2004 | Cho |
| 2004/0231031 | A1 | 11/2004 | Cho |
| 2004/0231033 | A1 | 11/2004 | Cho |
| 2004/0250336 | A1 | 12/2004 | Cho |
| 2005/0066419 | A1 | 3/2005 | Lee |
| 2005/0066420 | A1 | 3/2005 | Kim |
| 2005/0081279 | A1 | 4/2005 | Cho |
| 2005/0132469 | A1 | 6/2005 | Kim |
| 2005/0155135 | A1 | 7/2005 | Cho |
| 2005/0160518 | A1 | 7/2005 | Cho |
| 2005/0160519 | A1 | 7/2005 | Cho |
| 2005/0223472 | A1 | 10/2005 | Shin |
| 2005/0223473 | A1 | 10/2005 | Cho |

(Continued)

OTHER PUBLICATIONS

U.S. Appl. No. 11/516,893, Cho.

*Primary Examiner*—Gary L Welch
*Assistant Examiner*—Sally Colson Cline
(74) *Attorney, Agent, or Firm*—Fellers Snider Blankenship Bailey & Tippens, P.C.

(57) ABSTRACT

Provided are a size adjuster and a headwear using the same having advantages of increasing exterior aesthetical features and automatically adjusting a circumference of a wearing portion of a headwear. The size adjuster may include: a first guide having one end connected to the wearing portion; a second guide having one end connected to the wearing portion corresponding to a position of the first guide; a case having an inner portion connected to the respective other ends of the first and second guides and where the first and second guides move through; and an elastic band extended or contracted by connecting to the first and second guides.

20 Claims, 8 Drawing Sheets

U.S. PATENT DOCUMENTS

2005/0223474 A1 10/2005 Cho
2006/0048274 A1 3/2006 Lee
2006/0048275 A1 3/2006 Cho
2006/0090244 A1 5/2006 Cho
2007/0079424 A1 4/2007 Cho
2007/0083982 A1 4/2007 Cho

SIZE ADJUSTER AND HEADWEAR USING THE SAME

FIELD OF THE INVENTION

The present invention relates to a headwear. More particularly, the present invention relates to a size adjuster for automatically adjusting a size of a wearing portion of a headwear, and a headwear using the same.

BACKGROUND OF THE INVENTION

Description of the Related Art

A free-size headwear has been developed so as to be worn regardless a head size of various wearers. Such free-size headwear generally have an elastic band to be extended or contracted in a circumferential direction or a size adjusting portion for adjusting a head size in a circumferential direction, which are provided at a rear of a wearing portion put on a wearer's head However, in the case of using a size adjusting portion, it is difficult for the wearer to directly adjust the size adjusting portion because it is provided at the rear of the wearing portion. In addition, there is a problem in that the size adjusting portion must be manually adjusted, and also, it deteriorates an aesthetic aspect due to a deformation of the headwear.

Meanwhile, in the case of using an elastic band so as to adjust the size of the headwear, there is a problem in that it deteriorates an appearance because the elastic band is exposed, thereby reducing market quality.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a size adjuster and a headwear using the same having advantages of automatically adjusting a circumference of a wearing portion of a headwear. In addition, the present invention has been made in an effort to provide an automatic size adjuster and a headwear using the same having advantages of increasing market quality by maintaining a fine appearance.

In addition, the present invention has been made in an effort to provide an automatic size adjuster, and a headwear using the same, having advantages of maximizing an advertisement effect by providing a design such as an ornament or an advertisement on a headwear's size adjusting portion.

An exemplary embodiment of the present invention provides a size adjuster for automatically adjusting a size of a wearing portion. The size adjuster may include: a first guide having one end connected to the wearing portion; a second guide having one end connected to the wearing portion opposite to the first guide; a case having an inner portion connected to each other end of the first and second guides and where the first and second guides move through; and an elastic band extended or contracted by being connected to the first and second guides.

Another embodiment of the present invention provides a size adjuster for automatically adjusting a size of a wearing portion. The size adjuster may include: a second guide having one end connected to the wearing portion opposite to the first guide; a case having an inner portion connected to each other end of the first and second guides and where the first and second guides move through; and an elastic band extended or contracted along a longitudinal direction in an inner portion of the first and second guides and connected to the wearing portion.

Yet another embodiment of the present invention provides a headwear using an automatic size adjuster. The headwear may include: a wearing portion put on a head of a wearer; a first guide having one end connected to the wearing portion; a second guide having one end connected to the wearing portion opposite to the first guide; a case having an inner portion connected to each other end of the first and second guides and where the first and second guides move through; and an elastic band extended or contracted by being connected to the first and second guides.

Yet another embodiment of the present invention provides a headwear using an automatic size adjuster. The headwear may include: a wearing portion put on a head of a wearer; a first guide having one end connected to the wearing portion; a second guide having one end connected to the wearing portion corresponding to a position of the first guide; a case having an inner portion connected to the respective other ends of the first and second guides and where the first and second guides move through; and an elastic band extended or contracted along a longitudinal direction in an inner portion of the first and second guides and connected to the wearing portion.

The case may include a base member having a first fastening portion and a cover member having a second fastening portion connected to the first fastening portion.

The first fastening portion may include a groove opposed to each other along a longitudinal direction and the second fastening portion includes a protrusion sliding along the groove.

The case may have an advertisement portion at an outer portion thereof.

The first and second guides may respectively be sewn by a yarn at the one end to the wearing portion.

The case may have a hooking protrusion therein and the first and second guides respectively have a hooking protrusion corresponding to the hooking protrusion of the case.

The base member and cover member may respectively have a locking portion for locking a center portion of the elastic band therebetween.

The first guide may include first and second members engaged with each other, and the first and second members fix one end of the elastic band.

The first and second members may respectively have a locking portion at a portion corresponding to each other, and the locking portion including a groove or a protrusion inserted into the corresponding groove and fixing the one end of the elastic band therebetween.

The first and second members may respectively have a hooking protrusion and a hooking hole for engaging the first and second members with each other.

The second guide may include third and fourth members engaged with each other, and the third and fourth members fix the other end of the elastic band.

The third and fourth members may respectively have a locking portion at a portion corresponding to each other, and the locking portion including a groove and a protrusion inserted into the corresponding groove and fixing the other end of the elastic band therebetween.

The third and fourth members may have a hooking protrusion and a hooking hole for engaging the third and fourth members with each other.

DETAILED DESCRIPTION OF THE PREFERRED EMBODIMENTS

Exemplary embodiments of the present invention will hereinafter be described in detail with reference to the accompanying drawings.

Figure 1:
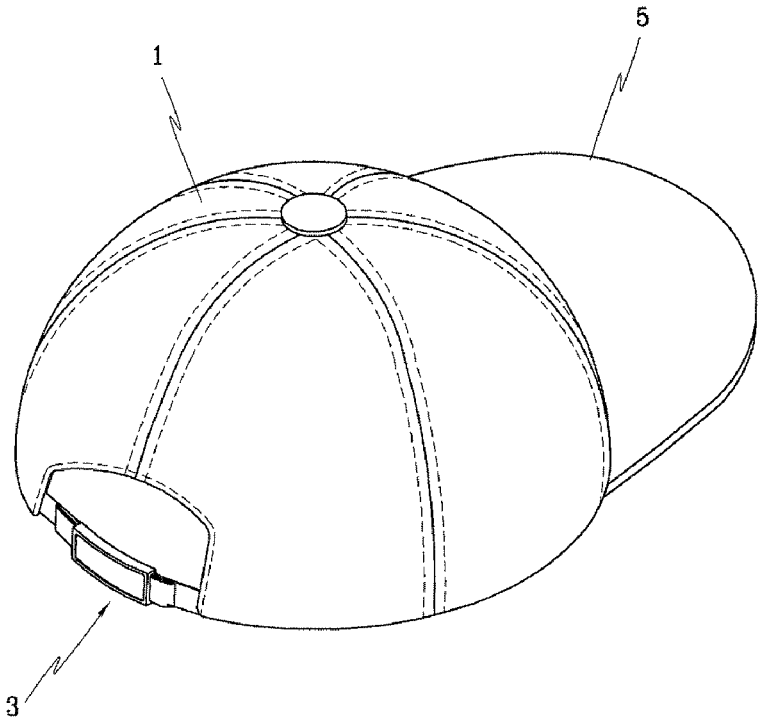
FIG. 1 is a perspective view of a headwear according to an exemplary embodiment of the present invention.
Figure 2:
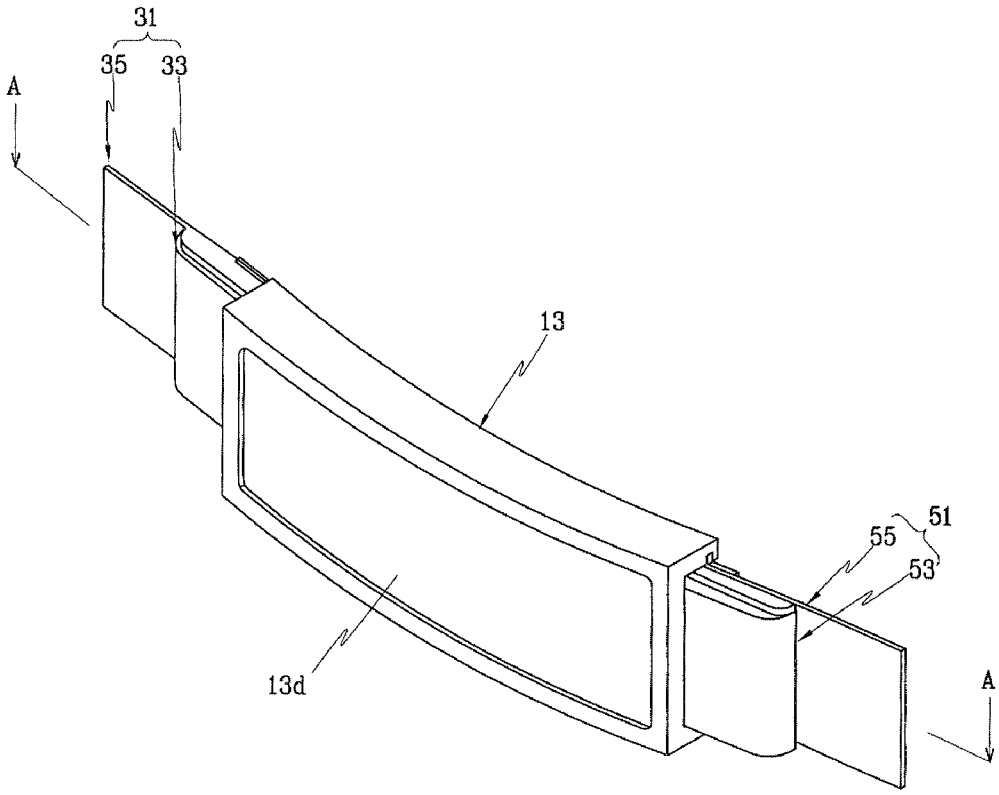
FIG. 2 is a partial perspective view of FIG. 1.
Figure 3:
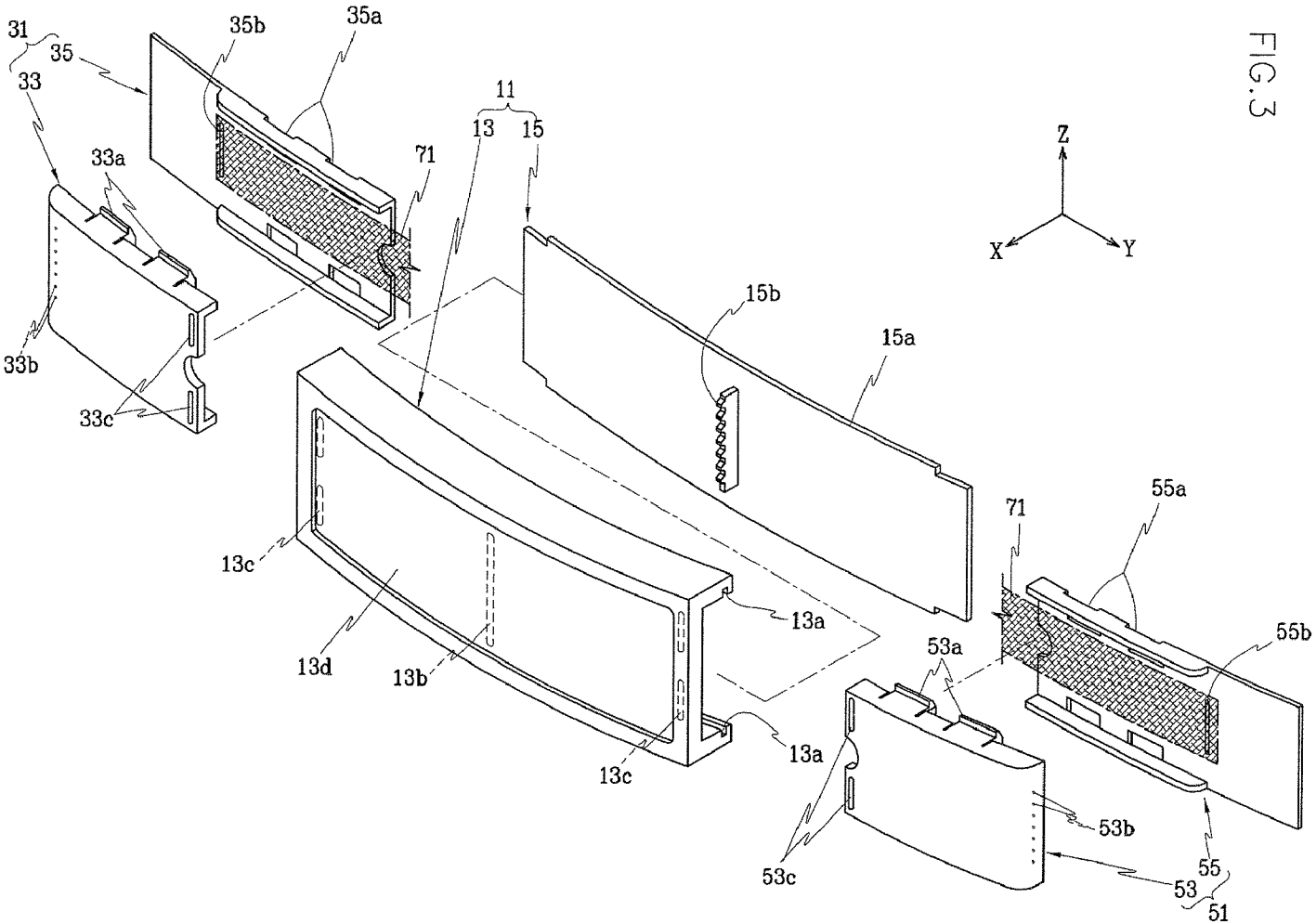
FIG. 3 is an exploded perspective view of FIG. 2.
Figure 4:
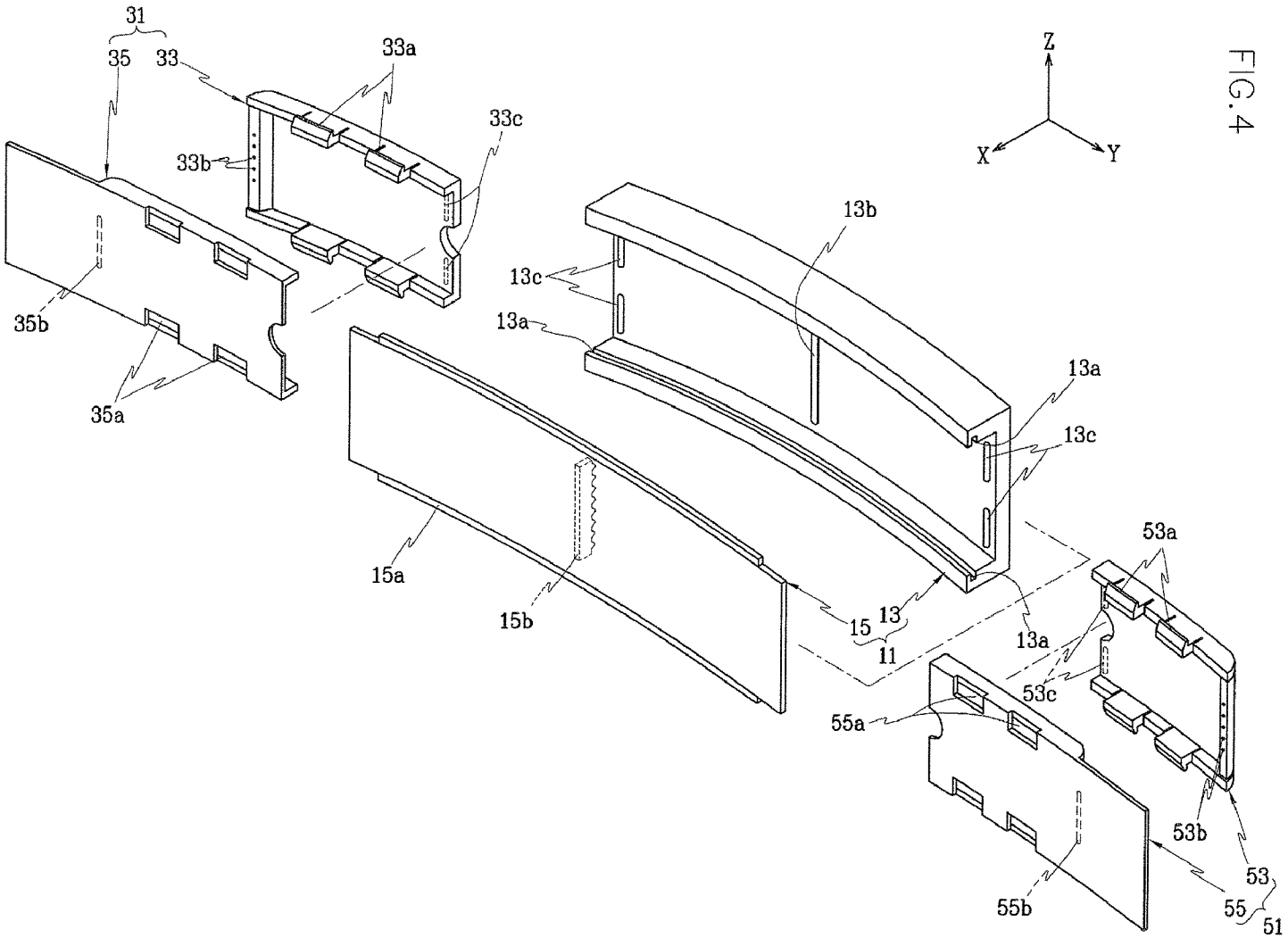
FIG. 4 is a perspective view viewed FIG. 3 in an opposite direction.

FIG. 1 is a perspective view of a headwear according to an exemplary embodiment of the present invention, FIG. 2 illustrates a size adjusting portion of FIG. 1, and FIG. 3 and FIG. 4 are exploded perspective views of FIG. 2. Specifically, FIG. 3 and FIG. 4 illustrate a size adjusting portion 3 connected to a wearing portion 1.

The size adjusting portion 3 is used to automatically adjust a circumferential length of the wearing portion 1.

In this embodiment, the headwear includes a general cap or a visor for shielding sunlight, whatever is put on a head of a wearer.

According to an exemplary embodiment of the present invention, the wearing portion 1 may be a crown portion for being worn on the head of the wearer. Such a wearing portion 1 may be combined with a visor portion 5 for shielding sunlight at a front portion thereof.

The wearing portion 1 has the size adjusting portion 3 connected at a rear portion thereof. The size adjusting portion 3 improves an external appearance and adjusts automatically the circumference of the wearing portion 1. A structure of the size adjusting portion 3 will be described in detail with reference to FIG. 2, FIG. 3, and FIG. 4.

The size adjusting portion 3 includes a case 11, a first guide 31, a second guide 51, and an elastic band 71.

The case 11 has both end portions opened such that the both end portions are communicated with each other. That is, the case 11 is formed as a substantially rectangular box having open end portions, and it has a cavity therein. In addition, the case 11 has a base member 13 and a cover member 15 engaged with each other.

The base member 13 is covered with the cover member 15 at an internal portion of the wearing portion 1. The base member 13 has a cavity therein, and also, has a fastening groove 13*a* opposed along a longitudinal direction.

The cover member 15 has a fastening protrusion 15*a* corresponding to the fastening groove 13*a*. The fastening protrusion 15*a* may be slid along the fastening groove 13*a*. The fastening protrusion 15*a* is formed at an edge portion along a longitudinal direction of the cover member 15. Accordingly, when the fastening protrusion 15*a* may be slid along the fastening groove 13*a*, the base member 13 may be covered with the cover member 15, thereby forming the case 11.

The case 11 formed in this manner has an open structure in which both end portions thereof are open and has a cavity therein. It is one example that the base member 13 and the cover member 15 are engaged in this manner, thereby forming the case 11. Alternatively, the groove may be formed on the cover member 15 and the protrusion may be formed on the base member 13.

In addition, the base member 13 and the cover member 15 respectively have a locking groove 13*b* or locking protrusion 15*b* at the center portions thereof such that the locking groove 13*b* and the locking protrusion 15*b* press the elastic band 71 therebetween and maintain the same at a center portion thereof. The locking groove 13*b* may be substantially formed in a slit shape and the locking protrusion 15*b* may be substantially formed in a tooth shape, opposed to each other. For example, the locking groove 13*b* and the locking protrusion 15*b* are formed substantially perpendicular to a longitudinal direction (along Z-axis direction in FIG. 3). They function to prevent the elastic band 71 from being moved.

That is, since the locking groove 13*b* and the locking protrusion 15*b* press the elastic band 71 perpendicularly to a longitudinal direction at the center portion thereof, the elastic band 71 may have a bilaterally equal elasticity from the center thereof in a circumferential direction of the wearing portion 1. In addition, although the elastic band 71 is repeatedly extended or contracted, the locking groove 13*b* and locking protrusion 15*b* may prevent the elastic band 71 from being twisted and may maintain an initial setting state thereof.

Figure 5:
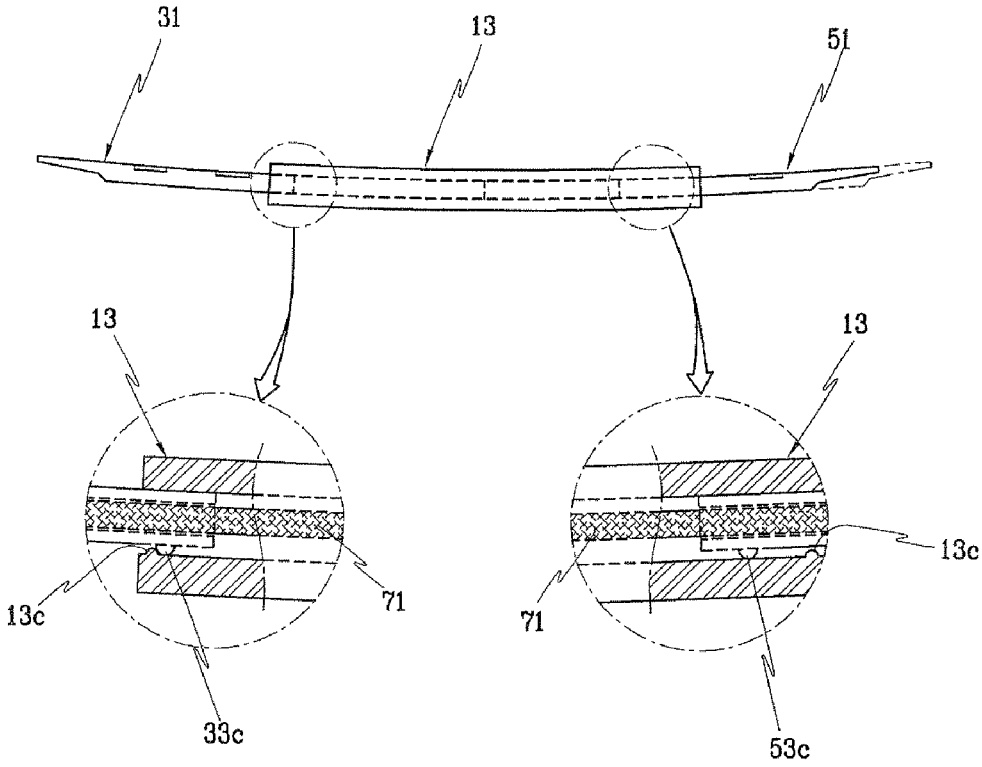
FIG. 5 is a cross-sectional view taken along line A-A of FIG. 2.

According to an exemplary embodiment of the present invention, the base member 13 includes a first hooking protrusion 13*c* (see FIG. 5). The first hooking protrusion 13*c* is protruded from both end portions of the bottom of the base member 13 toward the cover member 15.

The first hooking protrusion 13*c* is formed perpendicularly to a longitudinal direction (an X-axis direction of FIG. 3). In addition, a plurality of first hooking protrusions 13*c* may be disposed in parallel along a Z-axis direction (see FIG. 3). Such a hooking protrusion 13*c* prevents at least one end of the first and second guides 31 and 51 from being deviated from the case 11.

Meanwhile, the base member 13 may include an advertising portion 13*d* at an outer portion thereof such that a character or an ornamental design may be viewed. The advertising portion 13*d* may be caved into one surface of the base member 13.

It is one example that the advertising portion 13*d* is caved into one surface of the base member 13. The advertising portion 13*d* may be formed in a plane, so that an advertising copy is printed thereon, or printed matter, a character or an ornamental design may be attached or engraved. Such an advertising portion 13*d* can enhance an advertising impact of an enterprise because the advertising portion 13*d* maintains the fine appearance of the headwear.

Meanwhile, the first and second guides 31 and 51 are respectively disposed at both end portions of the case 11. The first and second guides 31 and 51 respectively have a free end sliding into the case 11 and a fixed end enough thin to be sewn with the wearing portion 1.

The first guide 31 may be sewn by a yarn 32 at the fixed end in the wearing portion 1 and the second guide 51 may be sewn in parallel to the first guide 31 by the yarn 32 at the fixed end in the wearing portion 1 in the above manner. At this time, the fixed end may preferably be thinner than other parts and the elastic band 71 may also be sewn by the yarn 32 at both sides thereof along with each fixed end of the first and second guides 31 and 32. In addition, the first and second guides 31 and 51 may cover the elastic band 71 such the elastic band 71 is not exposed.

Figure 6:
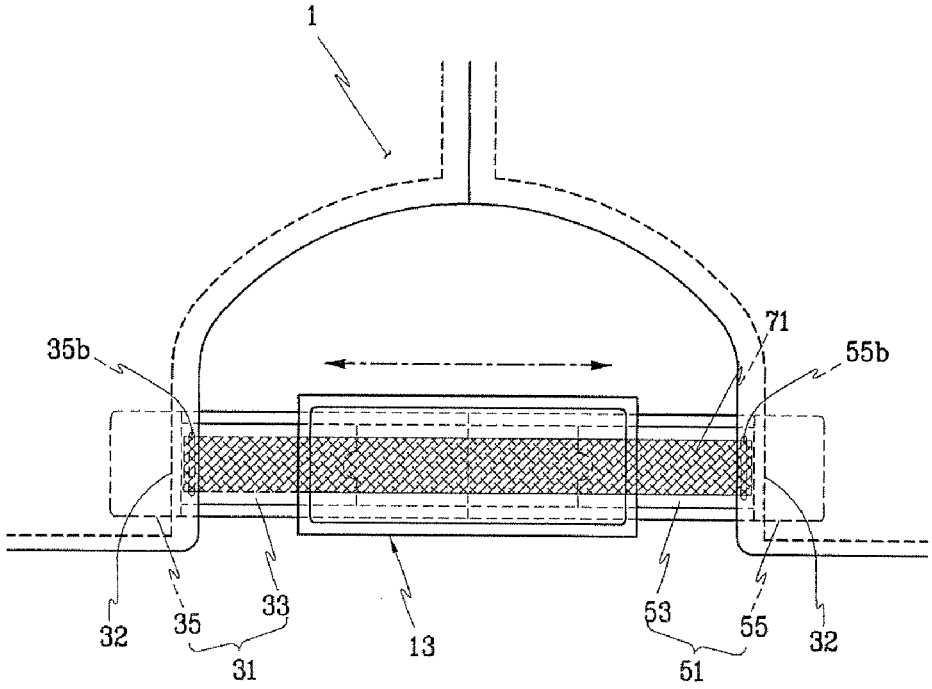
FIG. 6 is a perspective view for showing a wearing state of a headwear according to an exemplary embodiment of the present invention.

For end, the first guide 31 includes first and second members 33 and 35 engaged by an interference fit with each other. That is, the first member 33 is formed to have a cavity therein and the second member 35 is sliding into the first member 33, and accordingly, the second member 35 closes one surface of the first member 33. The second member 35 may be sewn by the yarn 32 (see FIG. 6) at the fixed end thereof to the wearing portion 1.

Of course, it is one example that the second member 35 is sewn by the yarn at the fixed end hereof to the wearing portion 1. Accordingly, the present invention is not limited thereto, and the first member 33 may be combined to the wearing portion 1 when either the first member 33 is extended to have the fixed end.

The first guide 31 may have a hooking protrusion 33*a* at the first member 33 and a hooking hole 35*a* at the second member 35. Accordingly, when the hooking protrusion 33*a* is inserted into the hooking hole 35*a*, the first member 33 may be engaged with the second member 35.

The first guide 31 may have a plurality of a band-locking protrusion 33*b* or a band-locking groove 35*b* opposed to each other at each fixed end of the first and second members 33 and 35, so that the band-locking protrusion 33*b* and the band-locking groove 35*b* may fix the one end of the elastic band 71. The band-locking protrusion 33*b* and the band-locking groove 35*b* are engaged with each other by an interference fit, with the band-locking protrusion 33*b* and the band-locking groove 35*b* having the elastic band 71 therebetween, and accordingly, they may fix the one end of the elastic band 71.

That is, the first and second guides may prevent the elastic band 71 from being exposed when extended or contracted, allow the elastic band 71 to be automatically extended or contracted, and improve the appearance of the headwear.

The second guide 51 disposed opposite to the first guide 31 has third and fourth members 53 and 55 engaged with each other. That is, the third member 53 has a cavity therein, and the fourth member 55 is sliding into the third member 53 and closes one surface of the third member 53. The fourth member 55 has a fixed end sewn by the yarn 32 (see FIG. 6) to the wearing portion 1 corresponding the second member 35 of the first guide 31.

Of course, it is one example that the fixed end of the fourth member 55 is sewn by the yarn 32 to the wearing portion 1. Accordingly, the third member 53 of the second guide 51 may be extended and connected by the yarn to the wearing portion 1.

The second guide 51 has a hooking protrusion 53*a* at the third member 53 and a hooking hole 55*a* at the fourth member 55. When the hooking protrusion 53*a* is inserted into the hooking hole 55*a*, the third member 53 is engaged with the fourth member 55. The second guide 51 may have a band-locking protrusion 53*b* and a band-locking groove 55*b* opposed to each other at each fixed end of the third and fourth members 53 and 55, so that the band-locking protrusion 53*b* and the band-locking groove 55*b* may fix the other end of the elastic band 71. The band-locking protrusion 53*b* and the band-locking groove 55*b* are engaged with each other by an interference fit, and accordingly, with the band-locking protrusion 53*b* and the band-locking groove 55*b* having the elastic band 71 therebetween, and accordingly, they may fix one end of the elastic band 71.

In addition, the first and third members 33 and 53 respectively have a plurality of hooking protrusions 33*c* and 53*c* (see FIG. 5) at the free end thereof opposite to the band locking protrusions 33*b* and 53*b*.

These hooking protrusions 33*c* and 53*c* may be engaged with the hooking protrusions 13*c* formed on the respective end of the base member 13 of the case 11, such that they limit the movement of the first and second guides 31 and 51 in the case 11. That is, even if the elastic band 71 is extended sufficiently in a circumferential direction, the first and second guides 31 and 51 are moved in the case 11, and accordingly, the first and second guides 31 and 51 are prevented from being deviated from the case 11. Such a structure allows an adjuster to be stably operated.

The elastic band 71 is preferably made from materials having excellent elasticity in a longitudinal direction.

How the headwear to be expanded or contracted according to an exemplary embodiment of the present invention will now be described.

When the wearer puts the headwear on their head, the wearing portion 1 is extended such that it fits the head size of the wearer. At this time, the elastic band 71 is extended along a circumferential direction (longitudinal direction). And then, the first and second guides 31 and 51 are slid and extended along with the elastic band 71 and moved in the case 11. On the other hand, when the headwear is taken off, the elastic band 71 is contracted along a circumferential direction (longitudinal direction). And then, the first and second guides 31 and 51 are slid and contracted along with the elastic band 71 and moved in the case 11.

As the first and second guides 31 and 51 surrounding the elastic band 71 are moved together in response to the extension or contraction of the elastic band 71 in this manner, the elastic band 71 may be prevented from being exteriorly exposed. Accordingly, the wearer may comfortably put the headwear on their head because the circumference of the wearing portion 1 is automatically extended or contracted, and also, the exterior aesthetical features may be maintained because the elastic band 71 is prevented from being exteriorly exposed.

In addition, since the exterior of the case 11 maintains a constant shape, the advertising design provided on the case 11 can be always viewed. Accordingly, according to an exemplary embodiment of the present invention, the advertising impact of an enterprise such as a sports marketing may be maximized by the headwear.

Figure 7:
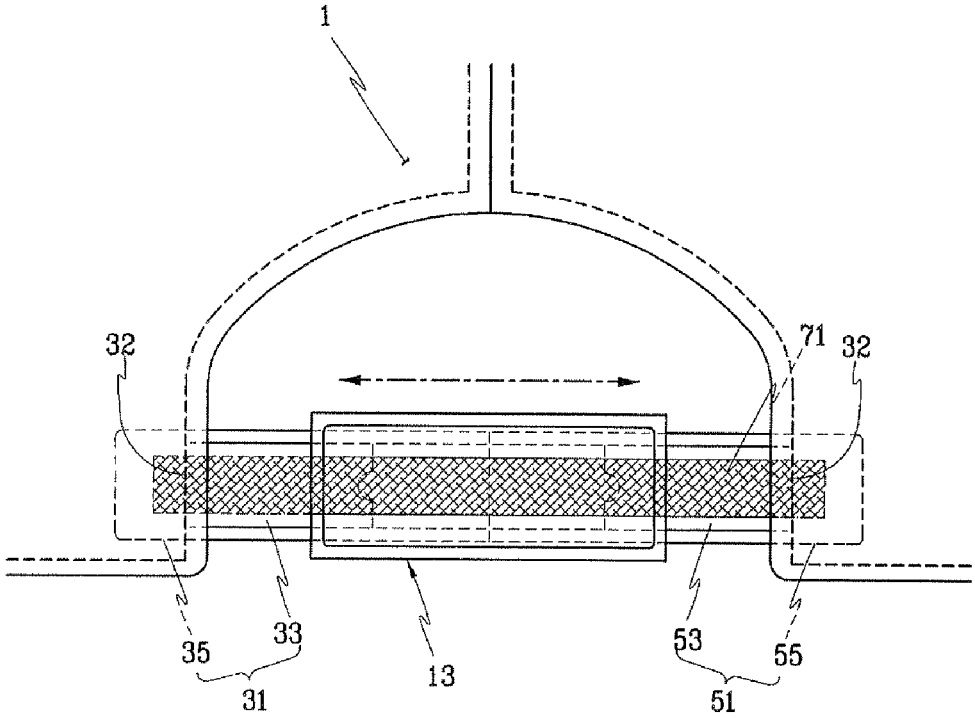
FIG. 7 is a perspective view of a headwear according to another exemplary embodiment of the present invention.

FIG. 7 is a perspective view of a headwear according to another exemplary embodiment of the present invention, in which the engagement of the elastic band 71 and the wearing portion sewn by the yarn 32 is illustrated. Such structure has the same actions as the above-noted exemplary embodiment. That is, the present invention may have various applications. The headwear according to another exemplary embodiment of the present invention shown in FIG. 7 has the same structure as the exemplary embodiment of the present invention shown in FIG. 1 except that the elastic band 71 is connected to the wearing portion. Accordingly, the same parts are not described for brief and convenient description.

Figure 8:
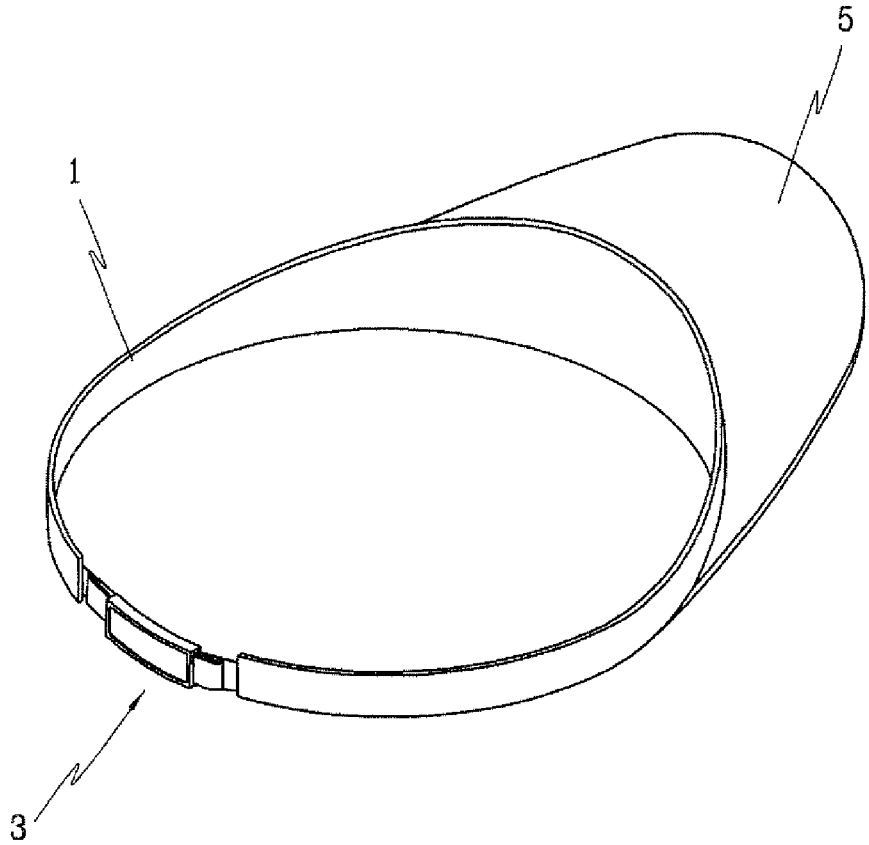
FIG. 8 is a perspective view of a visor according to an exemplary embodiment of the present invention.

FIG. 8 shows a visor according to an exemplary embodiment of the present invention. Accordingly, the headwear according to an exemplary embodiment of the present invention may include a cap, a visor, and anything to be put on the head of a wearer.

As such, since the headwear according to an exemplary embodiment of the present invention has a structure automatically extended or contracted along a circumferential direction of the wearing portion thereof, a free-size headwear may be conveniently put on a head.

In addition, since the headwear according to an exemplary embodiment of the present invention has no elastic band exposed, the exterior aesthetical features may be maintained.

In addition, since a character or design for ornamenting the headwear or advertising an enterprise may be provided on the size adjusting portion of the headwear, the advertising impact may be maximized.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A headwear using an automatic size adjuster comprising:

a wearing portion put on a head of a wearer;

a first guide having one end connected to the wearing portion;

a second guide having one end connected to the wearing portion opposite to the first guide;

a case having an inner portion connected to each other end of the first and second guides and where the first and second guides move through; and an elastic band extended or contracted by being connected to the first and second guides; wherein the case comprises a base member having a first fastening portion and a cover member having a second fastening portion connected to the first fastening portion and the first fastening portion includes a groove opposed to each other along a longitudinal direction and the second fastening portion includes a protrusion sliding along the groove.

2. The headwear of claim 1, wherein the case has an advertisement portion at an outer portion thereof.

3. The headwear of claim 1, wherein the first and second guides respectively are sewn by a yarn at one end to the wearing portion.

4. The headwear of claim 1, wherein the case has a hooking protrusion therein and the first and second guides respectively have a hooking protrusion corresponding to the hooking protrusion of the case.

5. The headwear of claim 1, wherein the base member and the cover member respectively have a locking portion for locking a center portion of the elastic band therebetween.

6. A headwear using an automatic size adjuster comprising:

a wearing portion put on a head of a wearer;

a first guide having one end connected to the wearing portion;

a second guide having one end connected to the wearing portion opposite to the first guide;

a case having an inner portion connected to each other end of the first and second guides and where the first and second guides move through; and an elastic band extended or contracted by being connected to the first and second guides; and wherein the first guide includes first and second members engaged with each other, and the first and second members fix one end of the elastic band.

7. The headwear of claim 6, wherein the first and second members respectively have a locking portion at a portion corresponding to each other, and the locking portion including a groove and a protrusion inserted into the corresponding groove and fixing one end of the elastic band therebetween.

8. The headwear of claim 7, wherein the first and second members respectively have a hooking protrusion and a hooking hole for engaging the first and second members with each other.

9. A headwear using an automatic size adjuster comprising:

a wearing portion put on a head of a wearer;

a first guide having one end connected to the wearing portion a second guide having one end connected to the wearing portion opposite to the first guide;

a case having an inner portion connected to each other end of the first and second guides and where the first and second guides move through; and an elastic band extended or contracted by being connected to the first and second guides;

wherein the second guide includes third and fourth members engaged with each other, and the third and fourth members fix the other end of the elastic band.

10. The headwear of claim 9, wherein the third and fourth members respectively have a locking portion at a portion corresponding to each other, the locking portion including a groove and a protrusion inserted into the corresponding groove and fixing the other end of the elastic band therebetween.

11. The headwear of claim 9, wherein the third and fourth members respectively have a hooking protrusion and a hooking hole for engaging the third and fourth members with each other.

12. A headwear using an automatic size adjuster comprising:

a wearing portion put on a head of a wearer;

a first guide having one end connected to the wearing portion;

a second guide having one end connected to the wearing portion corresponding to a position of the first guide;

a case having an inner portion connected to the respective other ends of the first and second guides and where the first and second guides move through; and an elastic band extended or contracted along a longitudinal direction in an inner portion of the first and second guides and connected to the wearing portion;

wherein the case comprises a base member having a first fastening portion and a cover member having a second fastening portion connected to the first fastening portion and the first fastening portion includes a groove opposed to each other along a longitudinal direction and the second fastening portion includes protrusion inserted into the groove.

13. The headwear of claim 12, wherein the case has an advertisement portion at an outer portion thereof.

14. The headwear of claim 12, wherein the first and second guides respectively have one end sewn by a yarn to the wearing portion.

15. The headwear of claim 12, wherein the case has a hooking protrusion therein and the first and second guides respectively have a hooking protrusion corresponding to the hooking protrusion of the case.

16. The headwear of claim 12, wherein the base member and the cover member respectively have a locking portion for locking a center portion of the elastic band therebetween.

17. A headwear using an automatic size adjuster comprising:

a wearing portion put on a head of a wearer;

a first guide having one end connected to the wearing portion;

a second guide having one end connected to the wearing portion corresponding to a position of the first guide;

a case having an inner portion connected to the respective other ends of the first and second guides and where the first and second guides move through; and an elastic band extended or contracted along a longitudinal direction in an inner portion of the first and second guides and connected to the wearing portion;

wherein the first guide includes first and second members engaged with each other, and the first and second members fix one end of the elastic band.

18. The headwear of claim 17, wherein the first and second members respectively have a hooking protrusion and a hooking hole for engaging the first and second members with each other.

19. A headwear using an automatic size adjuster comprising:

a wearing portion put on a head of a wearer;

a first guide having one end connected to the wearing portion;

a second guide having one end connected to the wearing portion corresponding to a position of the first guide;

a case having an inner portion connected to the respective other ends of the first and second guides and where the first and second guides move through; and an elastic band extended or contracted along a longitudinal direction in an inner portion of the first and second guides and connected to the wearing portion;

wherein the second guide includes third and fourth members engaged with each other, and the third and fourth members fix the other end of the elastic band.

20. The headwear of claim 19, wherein the third and fourth members respectively have a hooking protrusion and a hooking hole for engaging the third and fourth members with each other.

* * * * *